US007333748B2

(12) United States Patent
Nakaoka

(10) Patent No.: US 7,333,748 B2
(45) Date of Patent: Feb. 19, 2008

(54) DETACHABLY ATTACHED RECORDING MEDIUM SUPPLYING APPARATUS WITH LATERALLY ATTACHED CONVEYING PART AND IMAGE FORMING APPARATUS

(75) Inventor: Takeshi Nakaoka, Kashiwazaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/885,640

(22) Filed: Jul. 8, 2004

(65) Prior Publication Data

US 2005/0084284 A1 Apr. 21, 2005

(30) Foreign Application Priority Data

Oct. 16, 2003 (JP) ..... 2003-356173

(51) Int. Cl.
*G03G 15/00* (2006.01)

(52) U.S. Cl. ..... 399/107

(58) Field of Classification Search ..... 399/107, 399/124, 391, 393, 227, 302, 308
See application file for complete search history.

(56) References Cited

U.S. PATENT DOCUMENTS 5,065,197 A * 11/1991 Mitsuyama ..... 399/381
5,240,238 A * 8/1993 Lee ..... 271/9.11
6,049,346 A * 4/2000 Cho ..... 347/153
6,331,004 B1 * 12/2001 Katou et al. ..... 271/301
6,697,590 B2 * 2/2004 Inoue et al. ..... 399/124
6,775,515 B2 * 8/2004 Ouchi ..... 399/393
2005/0100362 A1 * 5/2005 Kim et al. ..... 399/107

FOREIGN PATENT DOCUMENTS

JP 9-54476 2/1997

* cited by examiner

*Primary Examiner*—Quana M. Grainger
(74) *Attorney, Agent, or Firm*—Morgan, Lewis & Bockius LLP

(57) ABSTRACT

A recording medium supplying apparatus includes a recording medium holding part that holds recording media, and a recording medium conveying part that conveys a recording medium from the recording medium holding part. Herein, the recording medium holding part is disposed below a housing to which it is to be attached, the recording medium conveying part is disposed at a side of the housing, and the recording medium holding part and the recording medium conveying part are detachably attached to the housing.

10 Claims, 7 Drawing Sheets

DETACHABLY ATTACHED RECORDING MEDIUM SUPPLYING APPARATUS WITH LATERALLY ATTACHED CONVEYING PART AND IMAGE FORMING APPARATUS

BACKGROUND OF THE INVENTION

1. Field of the Invention

The present invention relates to a recording medium supplying apparatus that supplies a recording medium, and an image forming apparatus that forms images on the recording medium.

2. Description of Related Art

Some existing image forming apparatuses including plural developing units form color images by developing units of four colors, yellow, magenta, cyan, and black. In this type of image forming apparatuses, as described in Japanese Published Unexamined Patent Application No. Hei 9-54476, a recording medium holding section is disposed below plural developing units, and a recording medium is conveyed upward from the recording medium holding section to form images.

However, in the related art, since the recording medium holding section is disposed fixedly below the developing units, it is difficult to reduce the height of the image forming apparatus.

SUMMARY OF THE INVENTION

An aspect of the present invention provides a compact image forming apparatus by reducing its height.

According to the aspect of the present invention, a recording medium supplying apparatus includes a recording medium holding part that holds recording media, and a recording medium conveying part that conveys a recording medium from the recording medium holding part. Herein, the recording medium holding part is disposed below a housing to which it is to be attached, the recording medium conveying part is disposed at a side of the housing, and the recording medium holding part and the recording medium conveying part are detachably attached to the housing. With this construction, the recording medium supplying apparatus can hold the recording medium below the housing and convey the recording medium at the side of the housing. Accordingly, the recording medium supplying apparatus can be optionally provided for the apparatus to which it is to be attached, to make the apparatus compact.

BRIEF DESCRIPTION OF THE DRAWINGS

An embodiment of the present invention will be described in detail based on the followings, wherein.

DETAILED DESCRIPTION OF THE INVENTION

Next, an embodiment of the present invention will be described with reference to the accompanying drawings.

Figure 1:
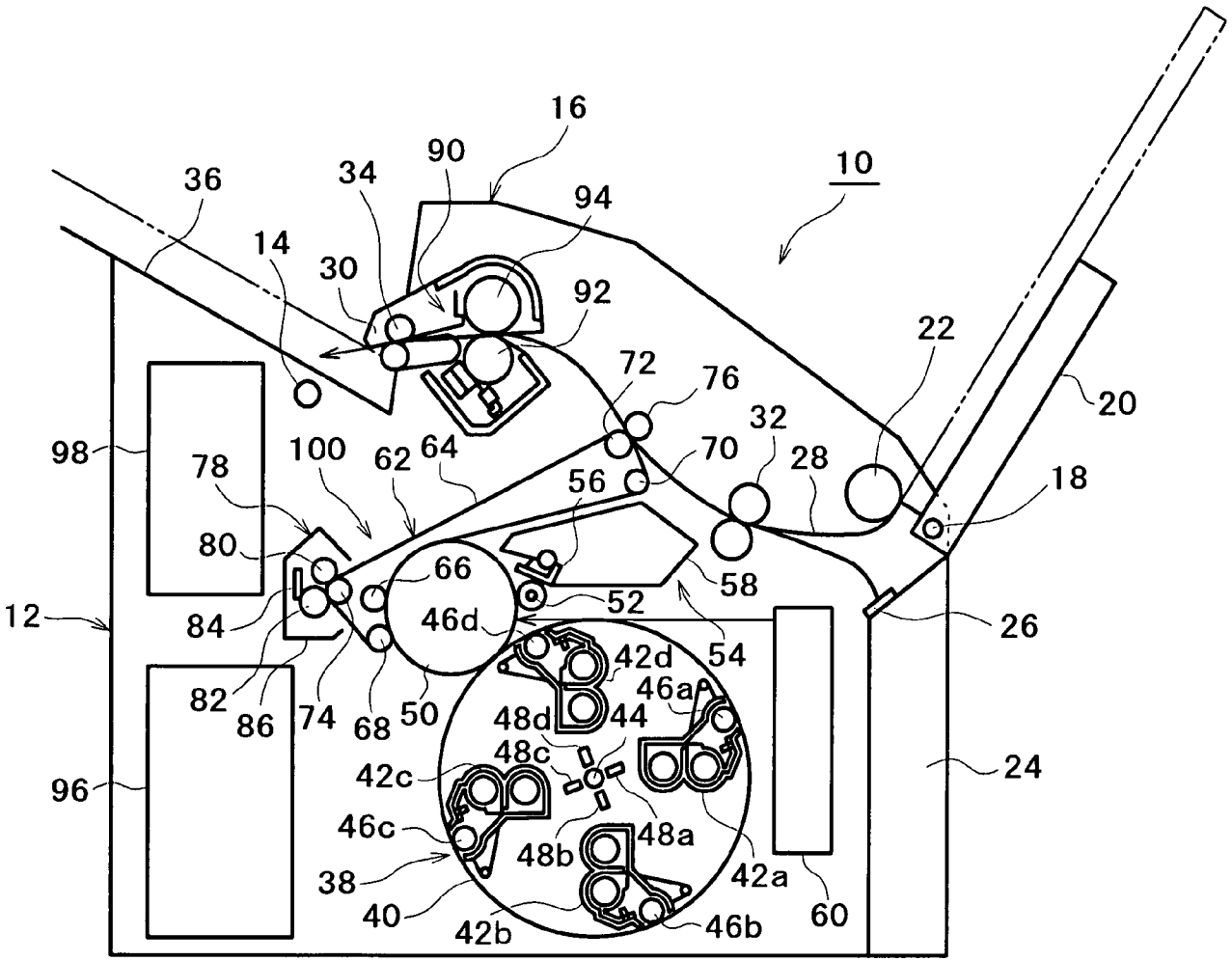
FIG. 1 is a side view showing an image forming apparatus according to an embodiment of the present invention.

In FIG. 1, an outline of an image forming apparatus 10 according to an embodiment of the present invention is shown. The image forming apparatus 10 includes an image forming apparatus body 12. A rotatable open/close part 16 with a rotation fulcrum 14 as an axis is provided at an upper part of the image forming apparatus body 12. On the opposite side of the rotation fulcrum of the open/close part 16, a first recording medium supplying apparatus 20 such as, e.g., a rotatable manual feed tray is provided, centering around the rotation fulcrum 18. The first recording medium supplying apparatus 20 is disposed above a rotary developing device 38, an image carrier 50, and an intermediate transfer device 62, which are will be described later. The first recording medium supplying apparatus 20 is disposed to incline, for example, within a range from 45 to 75 degrees with respect to a horizontal direction. At the side of the open/close part 16 of the first recording medium supplying apparatus 20, a pickup roller 22 that supplies a recording medium from the first recording medium supplying apparatus 20 is disposed.

The image forming apparatus body 12 has a removable front cover 24 at a lower part of its front (the right side of FIG. 1). By removing the front cover 24, a recording medium passage port 26 through which a recording medium passes is exposed, and may be equipped with an optional second recording medium supplying apparatus 102 described later.

A conveying path 28 is a recording medium passage from the pickup roller 22 to an ejection port 30. The conveying path 28 is in an upper part of the image forming apparatus body 12, and is formed almost horizontally from the first recording medium supplying apparatus 20 to a fixing device 90 described later. A secondary transfer roller 76 and a secondary transfer backup roller 72 which are described later are disposed upstream of the fixing device 90 of the conveying path 28. A resist roller 32 is disposed upstream of a secondary transfer roller 76 and a secondary transfer backup roller 72. An ejection roller 34 is disposed in the vicinity of the ejection port 30 of the conveying path 28.

By this construction, of recording media fed from the first recording medium supplying apparatus 20 by the pickup roller 22, only the top of them is guided to the conveying path 28 and temporarily halted by the resist roller 32. At a proper timing, toner images are transferred via between a secondary transfer roller 76 and a secondary transfer backup roller 72, and the transferred toner images are fixed by the fixing device 90 and the recording medium is ejected to an ejection part 36. The ejection part is inclined to be gradually higher from an ejection port toward the back (the left side of FIG. 1) of the image forming apparatus body 12.

The image forming apparatus body 12 has the rotary developing device 38 disposed at a lower part of the center thereof. The rotary developing unit 38 includes developing units 42*a* to 42*d* that respectively form toner images of four colors, yellow, magenta, cyan, and black within the developing unit body. The rotary developing device 38 rotates counterclockwise (counterclockwise in FIG. 1) with a rotary developing unit 44 at the center thereof. The developing units 42*a* to 42*d*, which include developing rollers 46*a* to 46*d*, respectively, are pressed in the direction of the normal to a developing unit body 40 by elastic materials 48*a* to 48*d* such as, e.g., coil springs.

An image carrier 50 formed from photoconductive material abuts with the rotary developing device 38. The developing rollers 46*a* to 46*d*, when they do not abut with the image carrier 50, are disposed inside the developing unit body 40 so that they are spaced e.g., 2 mm from the outer circumference of the developing unit body 40. For the developing rollers 46*a* to 46*d*, tracking rollers (not shown) each having a diameter a little larger than that of the developing rollers 46*a* to 46*d* are provided to rotate coaxially with the developing rollers 46*a* to 46*d*. In other words, the developing rollers 46*a* to 46*d* of the developing units 42*a* to 42*d* are respectively disposed inside the outer circumference of the developing unit body 40 at an interval of 90 degrees around the center 44 of the rotary developing unit. The tracking rollers of the developing rollers 46*a* to 46*d* are in contact with flanges (not shown) provided at each end of the image carrier 50, and with a given gap formed between the developing rollers 46*a* to 46*d* and the image carrier 50, latent images on the image carrier 50 are developed by the respective colors.

At the front side of the image carrier 50 (the right side of FIG. 1), a charging device 52 including charging rollers for uniformly charging the image carrier 50 is provided. An image carrier cleaner 54 abuts with the image carrier 50 upstream of the charging device 52 in a rotation direction of the image carrier 50. The image carrier cleaner 54 includes a cleaning blade 56 for scraping toner remaining in the image carrier 50 after primary transfer and a toner reclaim bottle 58 that reclaims the toner scraped by the cleaning blade 56.

An upper part of the front of the toner reclaim bottle 58 is curved, with a rib and the like formed thereon to constitute the conveying path 28 so that recording media are smoothly conveyed.

At the front side of the rotary developing device 38 (the right side of FIG. 1), an exposure device 60 for writing latent images onto the mage carrier 50 charged by the charging device 52 by laser light or other light beams is almost perpendicularly disposed. The intermediate transfer device 62 is provided above the rotary developing device 38. The intermediate transfer device 62 conveys toner images visualized by the rotary developing device 38 to a secondary transfer position described later after the toner images are subjected to primary transfer in a primary transfer position.

The intermediate transfer device 62 includes an intermediate transfer member 64 such as an intermediate transfer belt, a primary transfer roller 66, a wrapping roller 68, an unwrapping roller 70, a secondary transfer backup roller 72, and a belt cleaner backup roller 74. The intermediate transfer member 64 is elastic and almost stretched flat to have long and short sides above the image carrier 50.

The intermediate transfer member 64 has an image carrier wrapping area that is in close contact with the image carrier 50 between the wrapping roller 68 disposed upstream of the primary transfer roller 66 below the long side of the intermediate transfer member 64, and the unwrapping roller 70 disposed downstream of the primary transfer roller 66. The image carrier wrapping area wraps around the image carrier 50 in a predetermined part and moves in accordance with the rotation of the image carrier 50. Thus, toner images on the image carrier 50 are superimposed, for example, in the order of yellow, magenta, cyan, and black images and subjected to primary transfer to the intermediate transfer member 64 by the primary transfer roller 66, and the toner images are conveyed to a secondary transfer roller 76 described later.

The wrapping roller 68 and the unwrapping roller 70 are separate from the image carrier 50.

Moreover, a plane portion of the intermediate transfer member 64 is formed by the unwrapping roller 70 and the secondary transfer backup roller 72. The plane portion serves as a secondary transfer part and faces the conveying path 28.

In the secondary transfer part, the unwrapping roller 70 is disposed so that the intermediate transfer member 64 forms an angle of e.g., 12 degrees with respect to the conveying path 28.

The secondary transfer backup roller 72 of the intermediate transfer device 62 faces a secondary transfer roller 76 across the conveying path 28. Specifically, between the secondary transfer roller 76 and the secondary transfer backup roller 72 exists a secondary transfer position of the secondary transfer part. The secondary transfer roller 76 performs secondary transfer of toner images having been subjected to the primary transfer to the intermediate transfer member 64 to a recording medium in a secondary transfer position by means of the secondary transfer backup roller 72. The secondary transfer roller 76 is separate from the intermediate transfer member 64 while the intermediate transfer member 64 makes three rotations, that is, conveys toner images of three colors, yellow, magenta, and cyan. When a black toner image has been transferred, the secondary transfer roller 76 abuts with the intermediate transfer member 64. Arrangements are made so that a predetermined potential difference occurs between the secondary transfer roller 76 and the secondary transfer backup roller 72. For example, when the secondary transfer roller 76 is brought into high voltage, the secondary transfer backup roller 72 is connected to ground (GND) or the like.

The belt cleaner backup roller 74 assists in transferring toner remaining in the intermediate transfer member 64 to a belt cleaner roller 82 described later after the secondary transfer.

An intermediate transfer member cleaner 78 abuts with the intermediate transfer device 62 at a side opposite to the secondary transfer position. The intermediate transfer member cleaner 78 includes a brush roller 80 that scrapes toner remaining in the intermediate transfer member 64 after secondary transfer, a belt cleaner roller 82 that further transfers toner left after scraping by the brush roller 80 and performs cleaning, a scraper 84 that scrapes toner transferred to the belt cleaner roller 82, and a toner reclaim bottle 86 that reclaims scraped toner. The intermediate transfer member cleaner 78 is separate from the intermediate transfer member 64 while the intermediate transfer member 64 conveys toner images, and at a proper timing, abuts with the intermediate transfer member 64.

A fixing device 90 is disposed downstream of the secondary transfer position. The fixing device 90 includes a heating roller 92 and a pressing roller 94, and fixes the toner images having been subjected to the secondary transfer to the recording medium by the secondary transfer roller 76 and the secondary transfer backup roller 72 to the recording medium and conveys them to the ejection roller 34.

A power part 96 is disposed in the vicinity of the back surface (the left side of FIG. 1) of the image forming apparatus body 12, and supplies power to parts constituting the image forming apparatus 10. A control part 98 that controls sections constituting the image forming apparatus 10 is disposed above the power part 96.

An image forming unit 100 is an integration of the intermediate transfer device 62, the image carrier 50, the charging device 52, the image carrier cleaner 54, and the intermediate transfer member cleaner 78. The image forming unit 100 is disposed below the fixing device 90. For example, the intermediate transfer device 62 is disposed between the rotary developing device 38 and the fixing device 90, and detachably attached to the upper part of the image forming apparatus body 12 by opening the open/close cover 16.

Next, a description will be made of an optional second recording medium supplying apparatus 102, a third recording medium supplying apparatus 104, and the image forming apparatus 10 provided with them.

Figure 2:
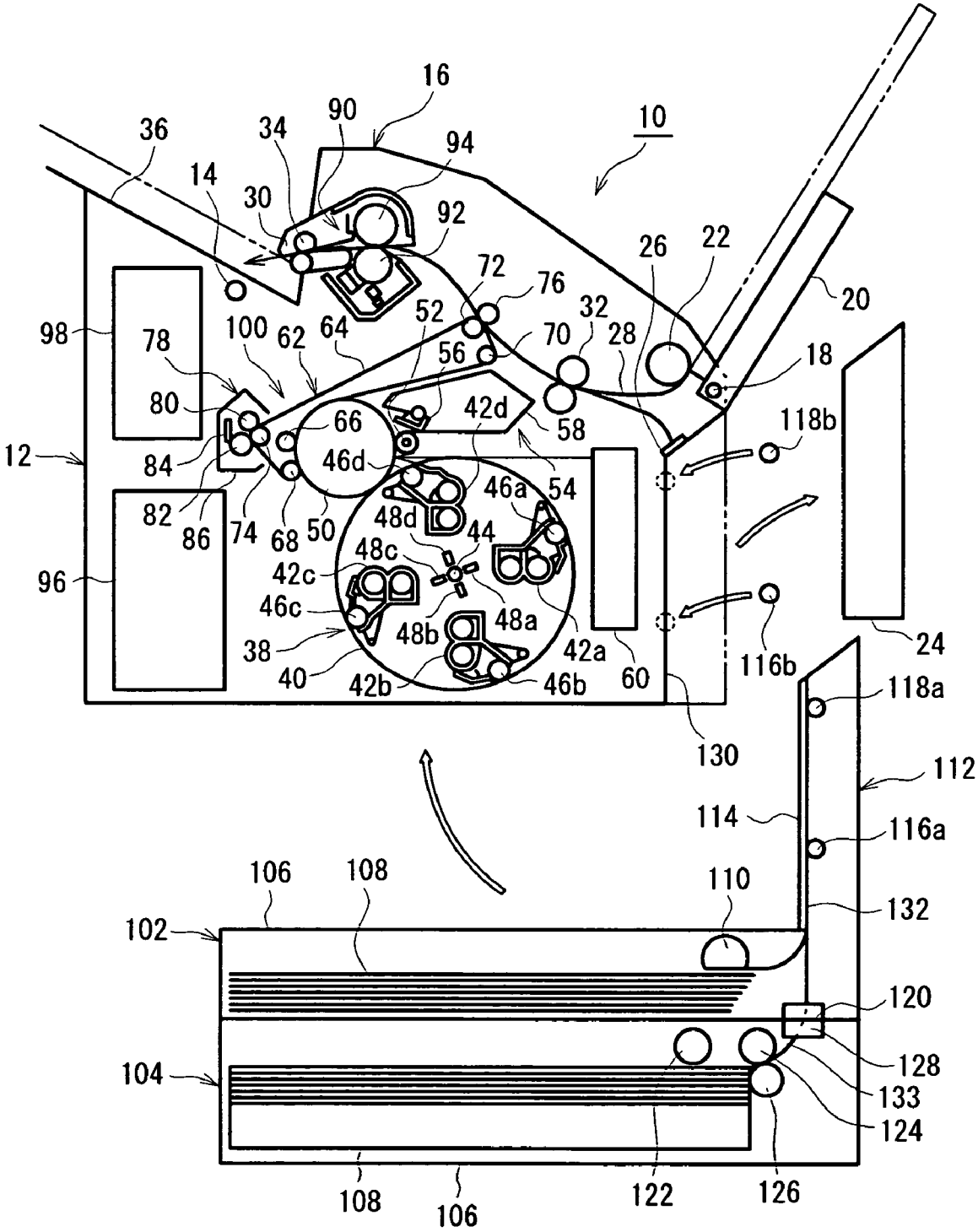
FIG. 2 is side view showing a method of attaching a recording medium supplying apparatus to an image forming apparatus according to an embodiment of the present invention.

FIG. 2 shows the optional second recording medium supplying apparatus 102, the third recording medium supplying apparatus 104, and a method of attaching them to the image forming apparatus 10. The second recording medium supplying apparatus 102 includes a recording medium supplying apparatus body 106, a recording medium supply cassette 108 in which recording media are stored, and a unit conveyance guide part 112 described later, which are unitized. A pickup roller 110 that supplies a recording medium from the recording medium supply cassette 108 is disposed in an upper part in the vicinity of the back of the recording medium supply cassette 108 of the second recording medium supplying apparatus 102. The unit conveyance guide part 112 is almost perpendicularly disposed in the back (the right side of FIG. 2) of the pickup roller 110. On an inner side of the unit conveyance guide part 112, a unit guide 114 formed like a rib is exposed, and conveying rollers 116*a* and 118*a* are provided. The conveying rollers 116*a* and 118*a* rotate so as to convey a recording medium upward from a lower position with conveying rollers 116*b* and 118*b* described later, respectively. A recording medium passage port 120 through which a recording medium passes is provided on a lower surface of the second recording medium supplying apparatus 102 below the conveying rollers 116*a* and 118*a*.

The third recording medium supplying apparatus 104 includes a recording medium supplying apparatus body 106, and a recording medium supply cassette 108 in which recording media are stored. The third recording medium supplying apparatus 104 and the second recording medium supplying apparatus 102 are detachably attached to each other. A pickup roller 122 that supplies a recording medium from the recording medium supply cassette 108 is disposed in an upper part of the back of the recording medium supply cassette 108 of the third recording medium supplying apparatus 104. A feed roller 124 and a retard roller 126 that settles supplied recording media one by one are disposed in an upper part in the vicinity of the back of the recording medium supply cassette 108. A recording medium passage port 128 through which a recording medium passes is provided in an upper surface of the third recording medium supplying apparatus 104 in the vicinity of the feed roller 124 and the roller 126.

The recording medium supplying apparatus 102, the third recording medium supplying apparatus 104, and the image forming apparatus body 12 may be integrally formed.

When a front cover 24 is removed from the image forming apparatus body 12, a body front 130 formed like a rib, and the recording medium passage port 26 disposed above the body front 130 are exposed. The conveying rollers 116*b* and 118*b* are rotatably attached to the body front 130. The second recording medium supplying apparatus 102 and the third recording medium supplying apparatus 104 are vertically stacked facing the respective recording medium passage ports 120 and 128, and are attached so that an upper surface of the second recording medium supplying apparatus 102 is in contact with a lower surface of the image forming apparatus body 12. When the second recording medium supplying apparatus 102 and the third recording medium supplying apparatus 104 have been attached below the image forming apparatus body 12, the unit guide 114 of the second recording medium supplying apparatus 102 faces the body front 130. Also, the conveying rollers 116*a* and 118*a* are brought into contact with the conveying rollers 116*b* and 118*b* attached to the body front 130, respectively.

Figure 3:
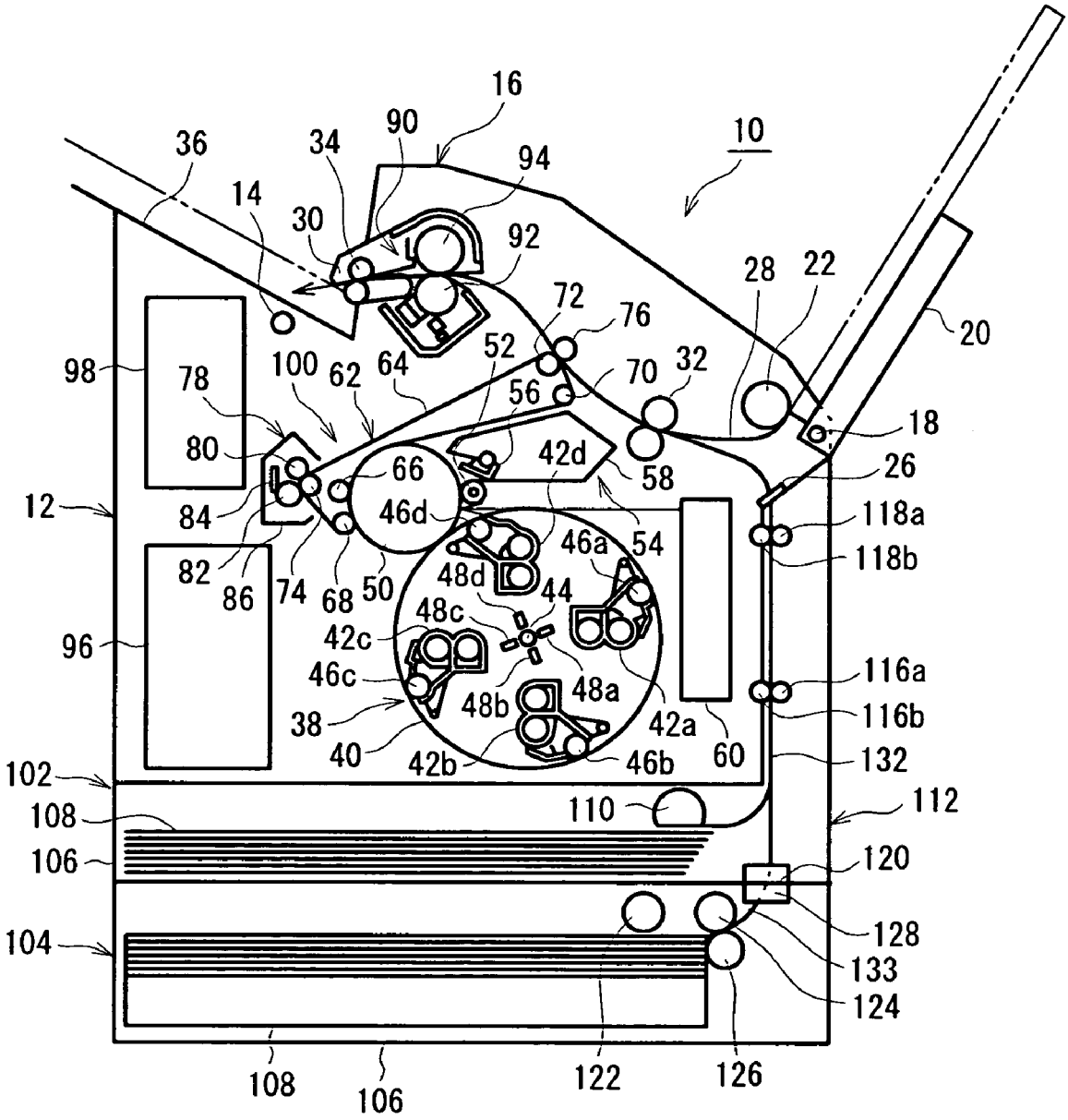
FIG. 3 is a side view showing an image forming apparatus according to an embodiment of the present invention to which a-recording medium supplying apparatus is attached.

Therefore, as shown in FIG. 3, when the second recording medium supplying apparatus 102 has been attached to the image forming apparatus body 12, the body front 130 and the unit guide 114 guide a recording medium, and a second conveying path 132 is formed through which the recording medium is perpendicularly conveyed from the pickup roller 110 to the resist roller 32 via the conveying rollers 116*a*, 116*b*, 118*a*, and 118*b*, and the recording medium passage port 26. Since the second recording medium supplying apparatus 102 and the third recording medium supplying apparatus 104 are vertically stacked and attached facing the recording medium passage ports 120 and 128 with each other, a third conveying path 133 is formed through which a recording medium is conveyed from the third recording medium supplying apparatus 104 to the second conveying path 132. Specifically, a recording medium fed from the third recording medium supplying apparatus 104 through the third conveying path 133 is guided to the second conveying path 132. The exposure device 60, as described above, is almost perpendicularly disposed at the front side (the right side of FIG. 3) of the rotary developing device 38, and provided almost in parallel with the unit conveyance guide part 112 between the image carrier 50 and the unit conveyance guide part 112.

Since the image carrier 50, the rotary developing device 38, the image forming unit 100, and the like are thus housed within the image forming apparatus body 12 including the body front 130, recording media stored in the second recording medium supplying apparatus 102 and the third recording medium supplying apparatus 104 are isolated from the image carrier 50, the rotary developing device 38, and the image forming unit 100, and the like until they are conveyed and pass through the recording medium passage port 26. With this construction, the recording media are prevented from being soiled by scattered toner.

Next, a description will be made of the action of the image forming apparatus 10 according to the abovementioned embodiment provided with the second recording medium supplying apparatus 102 and the third recording medium supplying apparatus 104.

When an image forming signal is sent from the control part 98, the image carrier 50 is uniformly charged by the charging device 52, and a light beam is emitted to the charged image carrier 50 from the exposure device 60, based on the image signal. The surface of the image carrier 50 is exposed to the light beam from the exposure device 60, whereby latent images are formed. The latent images of the image carrier 50 formed by the exposure device 60 are developed into yellow, magenta, cyan, and black toner images by the rotary developing device 38, and the developed toner images are subjected to primary transfer to the intermediate transfer member 64 in superimposed form. In the primary transfer, waste toners remaining in the image carrier 50 are scraped and reclaimed by the image carrier cleaner 54.

On the other hand, when the supplying of a recording medium from the first recording medium supplying apparatus 20 is selected by the control part 98, a recording medium stored in the first recording medium supplying apparatus 20 is fed by the pickup roller 22, guided to the conveying path 28, temporarily halted by the resist roller 32, and guided between the secondary transfer roller 76 and the secondary transfer backup roller 72 in a proper timing.

When the supplying of a recording medium from one of the second recording medium supplying apparatus 102 and the third recording medium supplying apparatus 104 is selected by the control part 98, a recording medium housed in one of the second recording medium supplying apparatus 102 and the third recording medium supplying apparatus 104 is guided to the second conveying path 132, temporarily halted by the resist roller 32, and guided between the secondary transfer roller 76 and the secondary transfer backup roller 72 at a proper timing.

When a recording medium is guided between the secondary transfer roller 76 and the secondary transfer backup roller 72, toner images having been subjected to primary transfer to the intermediate transfer member 64 are subjected to secondary transfer to the recording medium by the secondary transfer roller 76 and the secondary transfer backup roller 72. After the secondary transfer, waste toners remaining in the intermediate transfer member 64 are scraped and reclaimed by the intermediate transfer member cleaner 78. The recording medium to which the toner images have been transferred is guided to the fixing device 90, where the toner images are fixed by the heating roller 92 and the pressing roller 94. The recording medium in which the toner images have been fixed is ejected to the ejection unit 36 by the ejection roller 34.

Next, a method of attaching and detaching the image forming unit 100 will be described.

Figure 4:
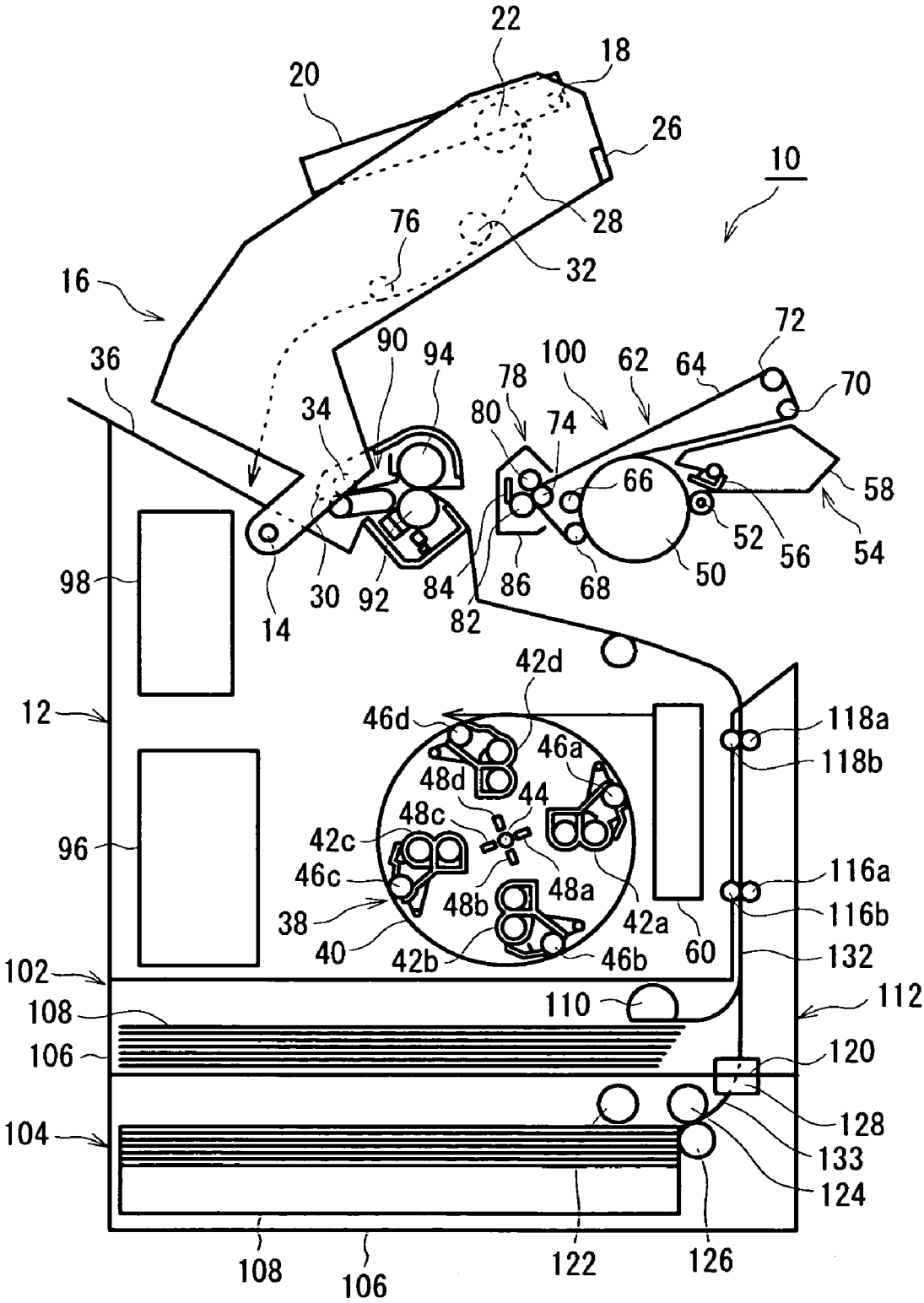
FIG. 4 is a side view showing an image forming apparatus according to an embodiment of the present invention from which an image forming unit is removed.

In FIG. 4, the image forming unit 100 is removed from the image forming apparatus 10. When the open/close part 16 is opened with the rotation fulcrum 14 as an axis, the first recording medium supplying apparatus 20, the pickup roller 22, and the secondary transfer roller 76 move with the open/close part 16, and an opening part 134 is formed in an upper part of the image forming apparatus body 12. The image forming unit 100 is detached upwardly through the opening part 134 from between the fixing device 90 and the rotary developing device 38 which are fixed to the image forming apparatus body 12. Handling for a recording medium jam, replacement of the developing units 42*a* to 42*d*, and other operations can be performed through the opening part 134.

Next, a first modification of the embodiment of the present invention will be described with reference to the accompanying drawing.

Figure 5:
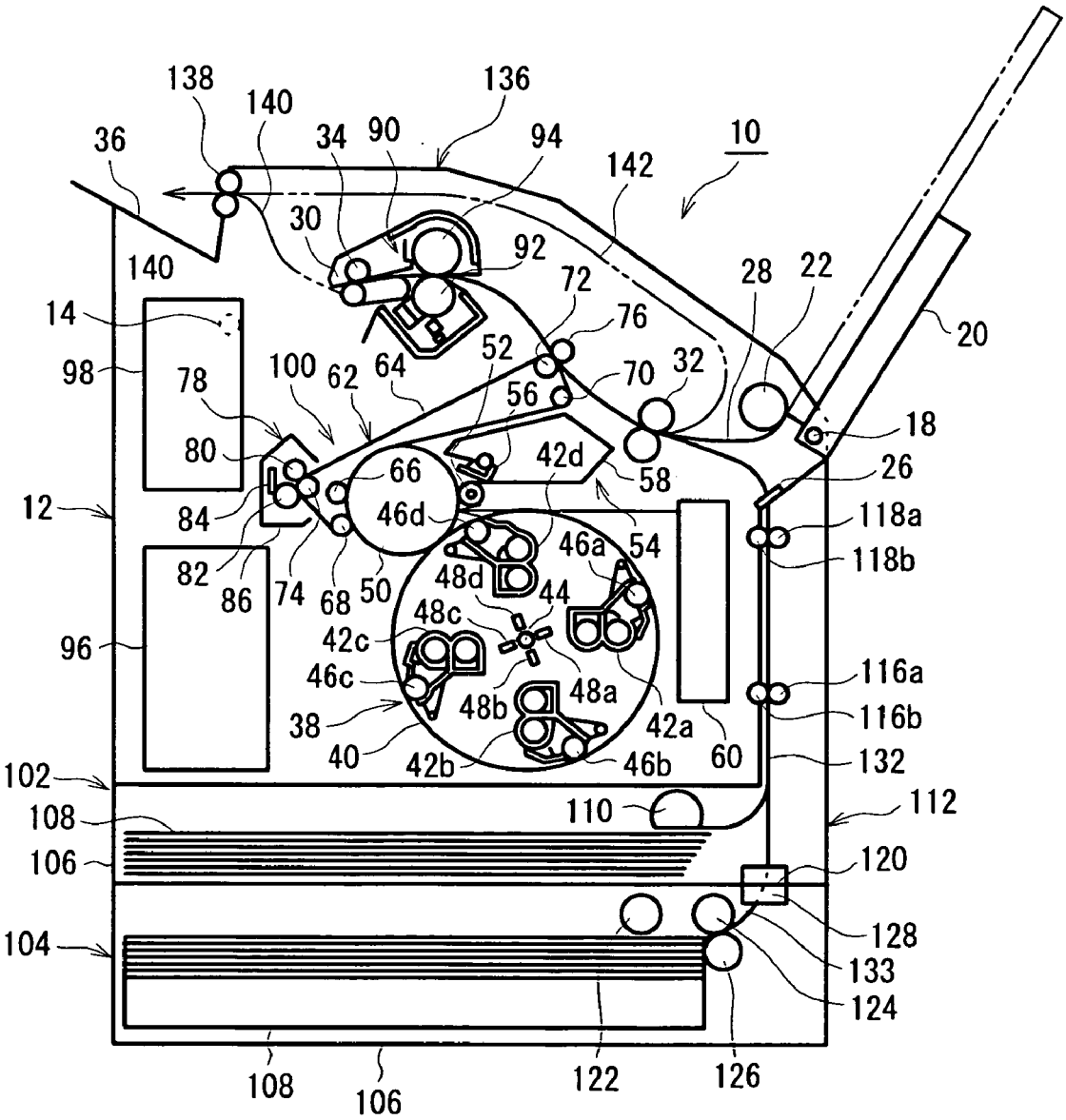
FIG. 5 is a side view showing a first modification of an image forming apparatus according to an embodiment of the present invention.

In FIG. 5, the first modification is shown.

In the first modification, components in FIG. 5 that are substantially the same as those of the image forming apparatus 10 according to the embodiment of the present invention are identified by the same reference numerals.

In the first modification, a rotatable open/close part 136 with the rotation fulcrum 14 as an axis is provided at an upper part of the image forming apparatus body 12. The open/close portion 136 is different from the open/close part 16 of the first embodiment in that it includes a reversing roller 138, and an ejection conveying path 140 and a reverse conveying path 142 are formed. The reversing roller 138 is disposed above the ejection roller 34 and projectingly to the back thereof. Specifically, the reversing roller 138 is disposed further away from the fixing device 90 than the ejection roller 34. The reversing roller 138 pinches a recording medium with a greater force than the ejection roller 34, and is rotated forward and reversely by a reversing motor not shown. The ejection conveying path 140 is a recording medium passage from the ejection roller 34 to the reversing roller 138, and the reverse conveying path 142 is a recording medium passage from the reversing roller 138 to the resist roller 32 via a conveying roller (not shown).

Therefore, during two-sided printing, a recording medium guided to the reversing roller 138 is fed to the back of the image forming apparatus 10 by the reversing roller 138 until the trailing edge of the recording medium is fed from the fixing device 90. When the trailing edge of the recording medium has been fed from the fixing device 90, the reversing roller 138 rotates reversely, and the recording medium is guided to the reverse conveying path 142. The recording medium guided to the reverse conveying path 142 is returned again to the resist roller 32 through the conveying roller (not show in the figure). The recording medium is temporarily halted by the resist roller 32, and toner images are transferred at a proper timing. The transferred toner images are fixed by the fixing device 90 and the recording medium is ejected to the ejection part 36 by forward rotation of the reversing roller 138.

The first modification thus constitutes an image forming apparatus capable of two-sided printing.

Next, a second modification of the embodiment of the present invention will be described with reference to the accompanying drawing.

Figure 6:
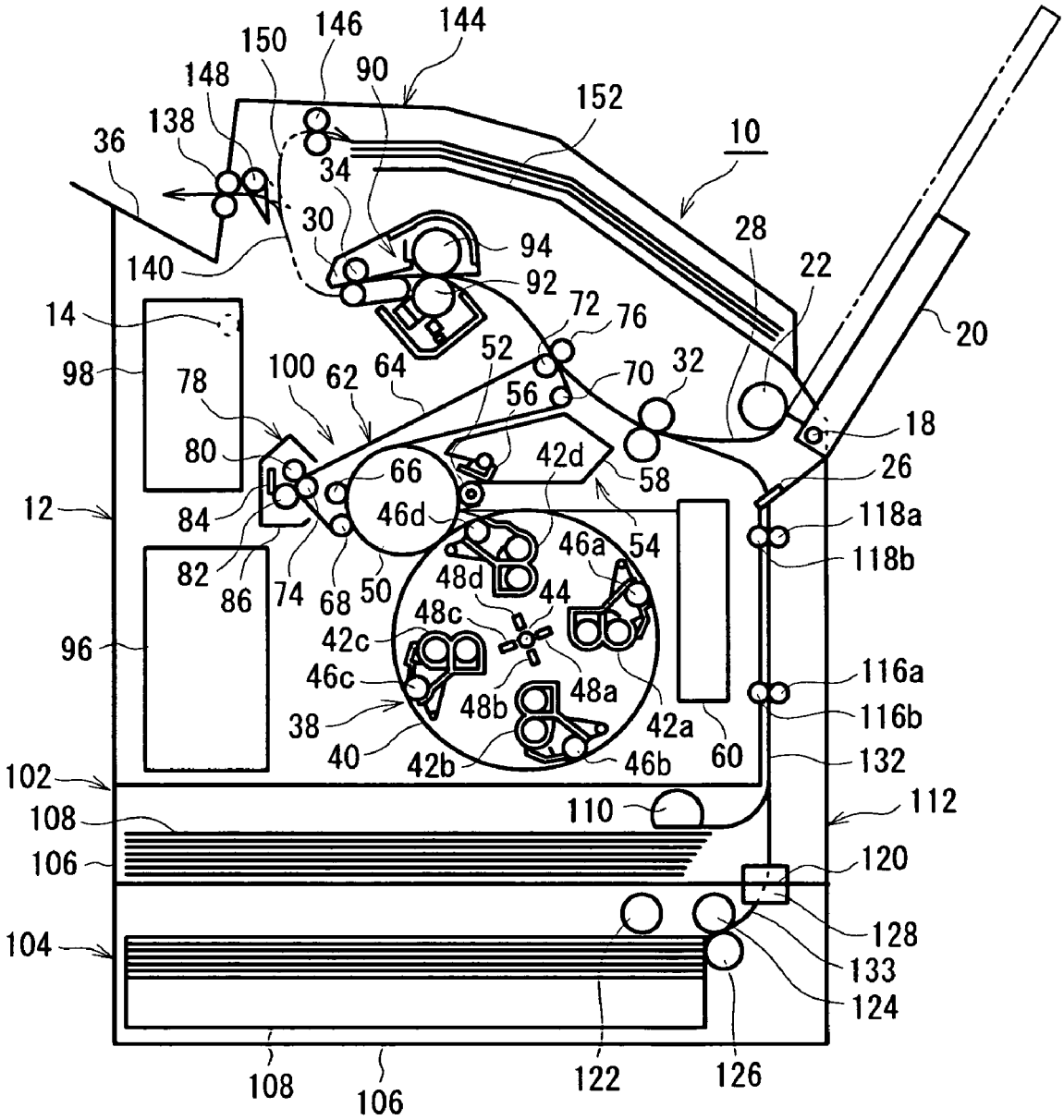
FIG. 6 is a side view showing a second modification of an image forming apparatus according to an embodiment of the present invention.

In FIG. 6, the second modification is shown.

In the second modification, components in FIG. 6 that are substantially the same as those of the image forming apparatus 10 according to the embodiment of the present invention and the first modification are identified by the same reference numerals.

In the second modification, a rotatable open/close part 144 with the rotation fulcrum 14 as an axis is provided at an upper part of the image forming apparatus body 12. The open/close portion 144 is different from the open/close part 136 of the first modification in that it includes an ejection roller 146 and a conveying path switcher 148, and an ejection conveying path 150 and an ejection part 152 are formed. The ejection roller 146, disposed above the ejection roller 34, is provided to eject a recording medium to the front side of the image forming apparatus 10. The conveying path switcher 148 is disposed downstream of the ejection roller 34. According to the switching of the conveying path switcher 148, a recording medium to which toner images have been fixed by the fixing device 90 is guided to one of the ejection roller 146 and the reversing roller 138. The ejection conveying path 150 is a recording medium passage from the ejection roller 34 to the ejection roller 146 through the conveying path switcher 148. It reverses a recording medium to which toner images have been fixed, and guides it to the ejection roller 146. The ejection part 152, disposed at an upper part of the open/close part 144, is formed with its upper side open, and inclined so as to be gradually lower from an ejection port toward the front side (the right side of FIG. 6), thereby preventing an ejected recording medium from dropping.

Accordingly, according to the switching of the conveying path switcher 148, the recording medium is ejected to the ejection part 36 or the ejection part 152, with printing faces reversed between the two cases.

In this way, the second modification allows free selection between face-down recording medium ejection with its printing face down and face-up recording medium ejection with its printing face up.

Next, a third modification of the embodiment of the present invention will be described with reference to the accompanying drawing.

Figure 7:
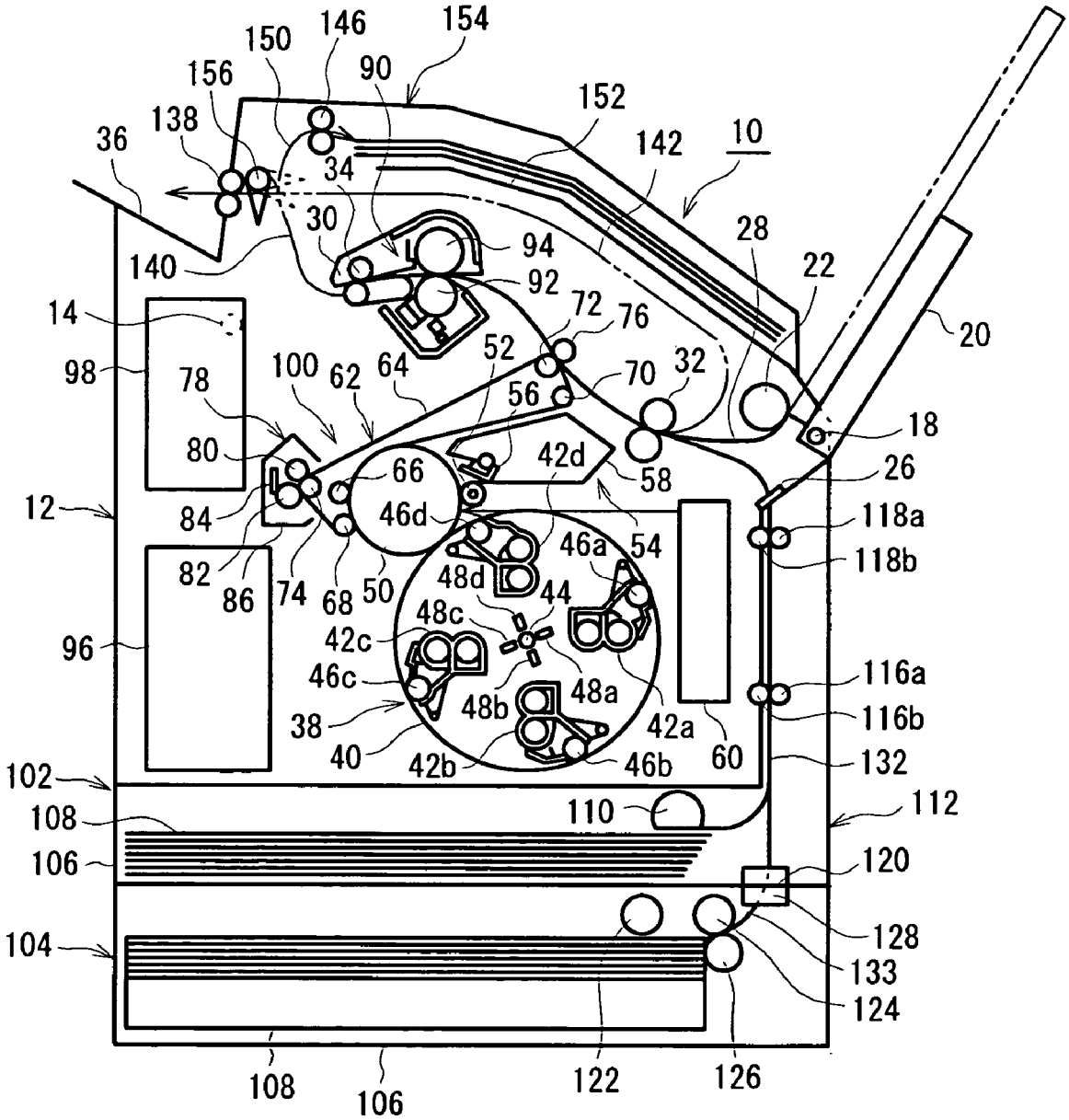
FIG. 7 is a side view showing a third modification of an image forming apparatus according to an embodiment of the present invention.

In FIG. 7, the third modification is shown.

In the third modification, components in FIG. 7 that are substantially the same as those of the first modification and the second modification are identified by the same reference numerals.

In the third modification, a rotatable open/close part 154 with the rotation fulcrum 14 as an axis is provided at an upper part of the image forming apparatus body 12. The open/close part 154 includes the reversing roller 138, the ejection roller 146, and a conveying path switcher 156. Moreover, the ejection conveying path 140, the reverse conveying path 142, the ejection conveying path 150, and the ejection part 152 are formed. The conveying path switcher 156 is disposed downstream of the ejection roller 34. According to the switching of the conveying path switcher 156, a recording medium fed by the ejection roller 34 is guided to one of the ejection roller 146 and the reversing roller 138. During printing, when the reversing roller 138 rotates reversely and the recording medium is fed to the front side, the conveying path switcher 156 guides the recording medium so that it is guided along the reverse conveying path 142 and again returned to the resist roller 32 via the ejection roller (not shown).

In this way, the third modification allows free selection among face-down recording medium ejection, face-up recording medium ejection, and two-sided printing.

As described above, according to an aspect of the present invention, a recording medium supplying apparatus includes a recording medium holding part that holds recording media, and a recording medium conveying part that conveys a recording medium from the recording medium holding part. Herein, the recording medium holding part is disposed below a housing to which it is to be attached, the recording medium conveying part is disposed at a side of the housing, and the recording medium holding part and the recording medium conveying part are detachably attached to the housing. With this construction, the recording medium supplying apparatus can hold the recording medium below the housing and convey the recording medium at the side of the housing. Accordingly, the recording medium supplying apparatus can be optionally provided for the apparatus to which it is to be attached, to make the apparatus compact.

According to another aspect of the present invention, an image forming apparatus includes an image forming section and an image forming apparatus body that houses the image forming section. Herein, the recording medium supplying apparatus that supplies a recording medium to the image forming section is detachably attached to the image forming apparatus body, and the recording medium supplying apparatus includes a recording medium holding part disposed below the image forming apparatus body, and a recording medium conveying part, disposed at a side of the image forming apparatus body, that conveys a recording medium from the recording medium holding part. With this construction, the recording medium supplying apparatus can be optionally provided which can hold the recording medium below the image forming apparatus body and convey the recording medium at the side of the image forming apparatus body. Accordingly, the image forming apparatus can be made compact.

According to another aspect of the present invention, an image forming apparatus includes an image forming section, an image forming apparatus body that houses the image forming section, and an recording medium supplying apparatus that supplies a recording medium to the image forming section. Herein, the recording medium supplying apparatus includes a recording medium holding section disposed below the image forming apparatus body, and a recording medium conveying section, disposed at a side of the image forming apparatus body, that conveys a recording medium from the recording medium holding section. Moreover, the recording medium supplying apparatus is detachably attached to the image forming apparatus body. With this construction, the recording medium supplying apparatus holds the recording medium below the image forming apparatus body and conveys the recording medium at the side of the image forming apparatus body. Accordingly, the image forming apparatus can be made compact.

The image forming section includes: an image carrier; plural developing units that develop latent images written onto the image carrier into toner images; an intermediate transfer device that conveys the toner images on the image carrier to a secondary transfer position after the toner images are transferred in a primary transfer position; a secondary transfer section that subjects the toner images to secondary transfer from the intermediate transfer device to a recording medium; a fixing device that fixes the toner images transferred to the recording medium; and a recording medium ejection section that ejects the recording medium to which the toner images are fixed. Preferably, the secondary transfer section, the fixing device, and the recording medium ejection section are disposed above the image carrier, the plural developing units, and the intermediate transfer device. Moreover, a shielding part may be provided which shields the recording medium holding part from the image carrier, the plural developing units, and the intermediate transfer device. The shielding part may also be provided which shields the recording medium conveying part from the image carrier, the plurality of developing units, and the intermediate transfer device. With this construction, the recording medium can be prevented from being soiled by toners scattered from the image carrier, the plural developing units, and the intermediate transfer device.

According to another aspect of the present invention, an image forming apparatus includes: an image forming section; an image forming apparatus body that houses the image forming section; a first recording medium supplying apparatus and a second recording medium supplying apparatus that supply a recording medium to the image forming section. Herein, the image forming section includes: an image carrier; plural developing units that develop latent images written onto the image carrier into toner images; an intermediate transfer device that conveys the toner images on the image carrier to a secondary transfer position after the toner images are transferred in a primary transfer position; a secondary transfer section that subjects the toner images to secondary transfer from the intermediate transfer device to a recording medium; a fixing device that fixes the toner images transferred to the recording medium; and a recording medium ejection section that ejects the recording medium to which the toner images are fixed. The secondary transfer section, the fixing device, and the recording medium ejection section are disposed above the image carrier, the plural developing units, and the intermediate transfer device. The first recording medium supplying apparatus is disposed above the image carrier, the plural developing units, and the intermediate transfer device. The second recording medium supplying apparatus includes a recording medium holding part disposed below the image forming apparatus body, and a recording medium conveying part, disposed at a side of the image forming apparatus body, that conveys a recording medium from the recording medium holding part. Moreover, the second recording medium supplying apparatus is detachably attached to the image forming apparatus body. With this construction, since a recording medium conveying path passing through the secondary transfer section and the fixing device from the first recording medium supplying apparatus can be made substantially horizontal, thick paper and the like can be stably conveyed.

The first recording medium supplying apparatus may be provided to be inclined within a range from 45 to 75 degrees with respect to a horizontal direction. With this construction, the area of the image forming apparatus required in the horizontal direction can be reduced.

A reverse conveying section may further be provided which reverses and conveys the recording medium from downstream of a recording medium conveyance direction of the fixing device to the secondary transfer position. With this construction, since the reverse conveying section is disposed in the image forming apparatus, the image forming apparatus can perform two-sided printing with reduced installation area.

According to another aspect of the present invention, an image forming apparatus includes: an image forming section; an image forming apparatus body that houses the image forming section; and a recording medium supplying apparatus that supplies a recording medium to the image forming section. Herein, the image forming section includes: an image carrier; plural developing units that develop toner images written onto the image carrier into toner images; an intermediate transfer device that conveys the toner images on the image carrier to a secondary transfer position after the toner images are transferred in a primary transfer position; a secondary transfer section that subjects the toner images to secondary transfer from the intermediate transfer device to a recording medium; a fixing device that fixes the toner images transferred to the recording medium; and a first recording medium ejection section and a second recording medium ejection section that eject the recording medium to which the toner images are fixed. The recording medium supplying apparatus includes a recording medium holding part disposed below the image forming apparatus body, and a recording medium conveying part, disposed at a side of the image forming apparatus body, that conveys a recording medium from the recording medium holding part. Moreover, the recording medium supplying apparatus is detachably attached to the image forming apparatus body. The secondary transfer section, the fixing device, and the first recording medium ejection section are disposed above the image carrier, and the plural developing units, and the intermediate transfer device. The second recording medium ejection section is disposed above the fixing device to eject the recording medium above the fixing device. With this construction, the image forming apparatus can be made compact, and at the same time, can eject a recording medium with its printing face down or up. Preferably, a selection section is further provided which selects between the first recording medium ejection section and the second recording medium ejection section to eject a recording medium. Thereby, the image forming apparatus allows free selection between face-down recording medium ejection and face-up recording medium ejection, greatly enhancing the usability of the image forming apparatus.

At an upper part of the image forming apparatus body, an open/close part may further be provided through which an image forming unit having at least an intermediate transfer member is attached to or detached from the image forming apparatus body. With this construction, even if the recording medium conveying path is provided at an upper part of the image forming apparatus, a consumable of the image forming part can be replaced from above the image forming apparatus body by opening the open/close part, easing maintenance on the image forming apparatus.

Moreover, the recording medium holding part and the recording medium conveying part may be unitized. With this construction, the recording medium holding part and the recording medium conveying part can be easily attached and detached.

A third recording medium supplying apparatus may further be provided below the second recording medium supplying apparatus, and the second recording medium supplying apparatus and the third recording medium supplying apparatus may be detachably attached to each other. With this construction, since the third recording medium supplying apparatus can be detached, the height of the image forming apparatus can be reduced according to the amount of recording media required.

According to the present invention, an image forming apparatus can be made compact by reducing its height.

The foregoing description of the embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2003-356173 filed on Oct. 16, 2003 including specification, claims, drawings and abstract is incorporated herein by reference in its entirety.

What is claimed is:

1. An image forming apparatus comprising:

an image forming section;

an image forming apparatus body that houses the image forming section; and a recording medium supplying apparatus that supplies a recording medium to the image forming section, wherein the recording medium supplying apparatus comprises: a recording medium holding part attached below the image forming apparatus body; and a recording medium conveying part, attached at a side of the image forming apparatus body, that conveys a recording medium from the recording medium holding part, and wherein the recording medium supplying apparatus is detachably attached to the image forming apparatus body;

wherein the image forming section comprises:

an image carrier;

a plurality of developing units each of which develops a latent images written onto the image carrier into a toner image;

an intermediate transfer device that conveys the toner image on the image carrier to a secondary transfer position after the toner image is transferred at a primary transfer position;

a secondary transfer section that carries out secondary transfer of the toner image from the intermediate transfer device to a recording medium;

a fixing device that fixes the toner image transferred to the recording medium; and a recording medium ejection section that ejects the recording medium to which the toner image is fixed, and the secondary transfer section, the fixing device, and the recording medium ejection section are disposed above the image carrier, the plurality of developing units, and the intermediate transfer device.

2. The image forming apparatus according to claim 1, further comprising:

a shielding part that shields the recording medium holding part from the image carrier, the plurality of developing units, and the intermediate transfer device.

3. The image forming apparatus according to claim 1, further comprising:

a shielding part that shields the recording medium conveying part from the image carrier, the plurality of developing units, and the intermediate transfer device.

4. An image forming apparatus comprising:

an image forming section which comprises: an image carrier; a plurality of developing units each of which develops a latent image written onto the image carrier into a toner image; an intermediate transfer device that conveys the toner image on the image camer to a secondary transfer position after the toner image is transferred at a primary transfer position; a secondary transfer section that carries out a secondary transfer of the toner image from the intermediate transfer device to a recording medium; a fixing device that fixes the toner image transferred to the recording medium; and a recording medium ejection section that ejects the recording medium to which the toner image is fixed;

an image forming apparatus body that houses the image forming section; and a first recording medium supplying apparatus and a second recording medium supplying apparatus that supply a recording medium to the image forming section, the second recording medium supplying apparatus, being detachably attached to the image forming apparatus body, comprising: a recording medium holding part disposed below the image forming apparatus body; and a recording medium conveying part, disposed at a side of the image forming apparatus body, that conveys a recording medium from the recording medium holding part, wherein the secondary transfer section, the fixing device, and the recording medium discharge section are disposed above the image carrier, the plurality of developing units, and the intermediate transfer device, and the first recording medium supplying apparatus is disposed above the image carrier, the plurality of developing units, and the intermediate transfer device.

5. The image forming apparatus according to claim 4, wherein the first recording medium supplying apparatus is inclined within a range from 45 to 75 degrees with respect to a horizontal direction.

6. The image forming apparatus according to claim 1, further comprising:

a reverse conveying section that reverses and conveys the recording medium from downstream of a recording medium conveyance direction of the fixing device to the secondary transfer position.

7. An image forming apparatus comprising:

an image forming section which comprises: an image carrier; a plurality of developing units each of which develops a latent image written onto the image carrier into a toner image; an intermediate transfer device that conveys the toner image on the image carrier to a secondary transfer position after the toner image is transferred at a primary transfer position; a secondary transfer section that carries out a secondary transfer of the toner image from the intermediate transfer device to a recording medium; a fixing device that fixes the toner image transferred to the recording medium; and a first recording medium ejecting section and a second recording medium ejecting section that eject the recording medium to which the toner image is fixed;

an image forming apparatus body that houses the image forming section; and a recording medium supplying apparatus that supplies a recording medium to the image forming section, the recording medium supplying apparatus being detachably attached to the image forming apparatus body, comprising: a recording medium holding part disposed below the image forming apparatus body; and a recording medium conveying part, disposed at a side of the image forming apparatus body, that conveys a recording medium from the recording medium holding part, wherein the secondary transfer section, the fixing device, and the first recording medium ejecting section are disposed above the image carrier, the plurality of developing units, and the intermediate transfer device, and the second recording medium ejecting section is disposed above the image carrier to eject the recording medium above the fixing device.

8. The image forming apparatus according to claim 7, further comprising:

a selection section that selects between the first recording medium ejection section and the second recording medium ejection section to eject the recording medium.

9. An image forming apparatus comprising:

an image forming section; and an image forming apparatus body that houses the image forming section, wherein a recording medium supplying apparatus that supplies a recording medium to the image forming section is detachably attached to the image forming apparatus body, and the recording medium supplying apparatus comprises: a recording medium holding part attached below the image forming apparatus body; and a recording medium conveying part, attached at a side of the image forming apparatus body, that conveys a recording medium from the recording medium holding part; and at an upper part of the image forming apparatus body, an open/close part through which an image forming unit having at least an intermediate transfer member is detachably attached to the image forming apparatus body.

10. The image forming apparatus according to claim 4, further comprising:

a third recording medium supplying apparatus below the second recording medium supplying apparatus, wherein the second recording medium supplying apparatus and the third recording medium supplying apparatus are detachably attached to each other.

* * * * *